US006453820B1

(12) United States Patent
Anderson

(10) Patent No.: US 6,453,820 B1
(45) Date of Patent: Sep. 24, 2002

(54) ROTATING TUBULAR PROJECTILE

(76) Inventor: Ralph D. Anderson, 251 Highway 48, Cumberland, WI (US) 54829

( * ) Notice: Subject to any disclaimer, the term of this patent is extended or adjusted under 35 U.S.C. 154(b) by 0 days.

(21) Appl. No.: 09/976,954

(22) Filed: Oct. 15, 2001

(51) Int. Cl.[7] ..... F42B 10/34; F42B 12/34

(52) U.S. Cl. ..... 102/503; 102/439; 102/448; 102/508; 244/3.23

(58) Field of Search ..... 102/501, 503, 102/507–516, 439, 448; 244/3.23

(56) References Cited

U.S. PATENT DOCUMENTS

| | | | | | |
|---|---|---|---|---|---|
| 14,742 | A | * | 4/1856 | Smith | 102/503 |
| 169,734 | A | * | 11/1875 | Schalck | 102/503 |
| 183,009 | A | * | 10/1876 | Kellogg | 102/503 |
| 219,840 | A | | 9/1879 | Winchester | |
| 966,744 | A | * | 8/1910 | Hendrix | 244/3.23 |
| 3,062,145 | A | * | 11/1962 | Morgan | 102/439 |
| 4,016,817 | A | | 4/1977 | Blanco | |
| 4,063,511 | A | | 12/1977 | Bullard | |
| 4,301,736 | A | | 11/1981 | Flatau et al. | |
| 4,627,357 | A | * | 12/1986 | Gobis | 102/503 |
| 4,805,535 | A | * | 2/1989 | Marcon | 102/503 |
| 4,829,904 | A | | 5/1989 | Sullivan | |
| 4,995,318 | A | * | 2/1991 | Stidston et al. | 102/503 |
| 5,275,110 | A | | 1/1994 | Flatau | |
| 5,515,787 | A | * | 5/1996 | Middleton | 102/503 |

FOREIGN PATENT DOCUMENTS

| | | | | |
|---|---|---|---|---|
| GB | 134896 | * | 11/1919 | 102/503 |

* cited by examiner

*Primary Examiner*—Harold J. Tudor
(74) *Attorney, Agent, or Firm*—Gregory L. Koeller

(57) ABSTRACT

A rotating tubular projectile for increasing the stability of the projectile and the accuracy of the firearm. The rotating tubular projectile includes a cylindrical body having an open first end. The cylindrical body has an axial passageway that extends through the open first end. Additionally, a spiraled airfoil is mounted in the axial passageway of the cylindrical body for impinging a flow of air flowing through the axial passageway. In one embodiment of the present invention the spiraled airfoil rotates the cylindrical body with respect to a longitudinal axis of the cylindrical body as it travels through the barrel and away from the firearm.

5 Claims, 3 Drawing Sheets

ROTATING TUBULAR PROJECTILE

BACKGROUND OF THE INVENTION

1. Field of the Invention

The present invention relates to projectiles and more particularly pertains to a new rotating tubular projectile for being fired from a barrel of a firearm, whereby the rotation of the rotating projectile increases the stability of the projectile and the accuracy of the firearm.

2. Description of the Prior Art

The use of projectiles is known in the prior art. More specifically, projectiles heretofore devised and utilized are known to consist basically of familiar, expected and obvious structural configurations, notwithstanding the myriad of designs encompassed by the crowded prior art that have been developed for the fulfillment of countless objectives and requirements.

Known prior art includes U.S. Pat. Nos. 5,275,110; 4,301,736; 5,515,787; 4,063,511; 4,829,904; and 4,016,817.

Historically, projectiles of ammunitions were fired from firearms having a barrel with a smooth bore. However, these firearms often had very poor accuracy. These projectiles would generally pitch and yaw or tumble as they traveled through the air, which results in the instability of the projectile and increased inaccuracy of the firearm.

There have been several advancements through the years to increase the stability of projectiles and to increase the accuracy of firearms. One such advancement was to rifle or cut grooves into the interior of the barrel of a firearm. The rifled barrel imparts rotation onto a projectile traveling through the barrel. The rotation of the projectile prevents it from pitching and yawing, thereby increasing the stability of the projectile and the accuracy of the firearm. Although the stability of the projectile is increased by rifling the barrel of a firearm, the projectile's velocity is decreased due to an increase in the friction between the rifled bore and the projectile.

To reduce the increased friction between the projectile and the barrel of the rifled firearm, a sabot or plastic covering is employed that has a reduced coefficient of friction. However, the use of a sabot requires the use of a smaller projectile resulting in decreased damage to a target.

Another advancement was spiraled ribs mounted on an exterior of a projectile. The exterior ribs rotate the projectile as it travels through the barrel and through the air. However, many of these projectiles have blunt leading ends that result in increased drag of the projectile. Hollow projectiles have been employed to reduce the drag experienced by projectiles traveling through the air. However, it's argued that these projectiles lack the stability of ribbed projectiles that rotate or spin as they travel through the air.

SUMMARY OF THE INVENTION

In view of the foregoing disadvantages inherent in the known types of ammunitions now present in the prior art, the present invention provides a new rotating tubular projectile construction wherein the same can be utilized for rotating through a barrel of a firearm, thereby increasing the stability of the projectile and the accuracy of the firearm.

The general purpose of the present invention, which will be described subsequently in greater detail, is to provide a new rotating tubular projectile apparatus and method which has many of the advantages of the projectiles mentioned heretofore and many novel features that result in a new rotating tubular projectile which is not anticipated, rendered obvious, suggested, or even implied by any of the prior art projectiles, either alone or in any combination thereof.

The present inventive resolves the aforementioned problems and includes a cylindrical body having an open first end and an axial passageway that extends through the open first end. Additionally, a spiraled airfoil is mounted in the axial passageway of the cylindrical body for impinging a flow of air flowing through the axial passageway. In one embodiment of the present invention the spiraled airfoil rotates the cylindrical body with respect to a longitudinal axis of the cylindrical body as it travels through the barrel and away from the firearm.

There has thus been outlined, rather broadly, the more important features of the rotating tubular projectile in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is an object of the present invention to provide a new rotating tubular projectile apparatus and method which has many of the advantages of the projectiles mentioned heretofore and many novel features that result in a new rotating tubular projectile which is not anticipated, rendered obvious, suggested, or even implied by any of the prior art projectiles, either alone or in any combination thereof.

Still another object of the present invention is to provide a new rotating tubular projectile that employs two features of conventional projectiles to produce a new and novel projectile. The present invention employs a tubular body for permitting air to flow through the cylindrical body thereby reducing drag and increasing the projectiles velocity. The present invention also employs an internal airfoil for impinging the airflow traveling through the cylindrical body whereby the projectile rotates as it travels through the air.

Still yet another object of the present invention is to provide a new rotating tubular projectile that can be employed in rifled and smooth-bored firearms. An additional object of the present invention is to provide a rotating tubular projection that expands upon impact creating a larger wound in the target.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
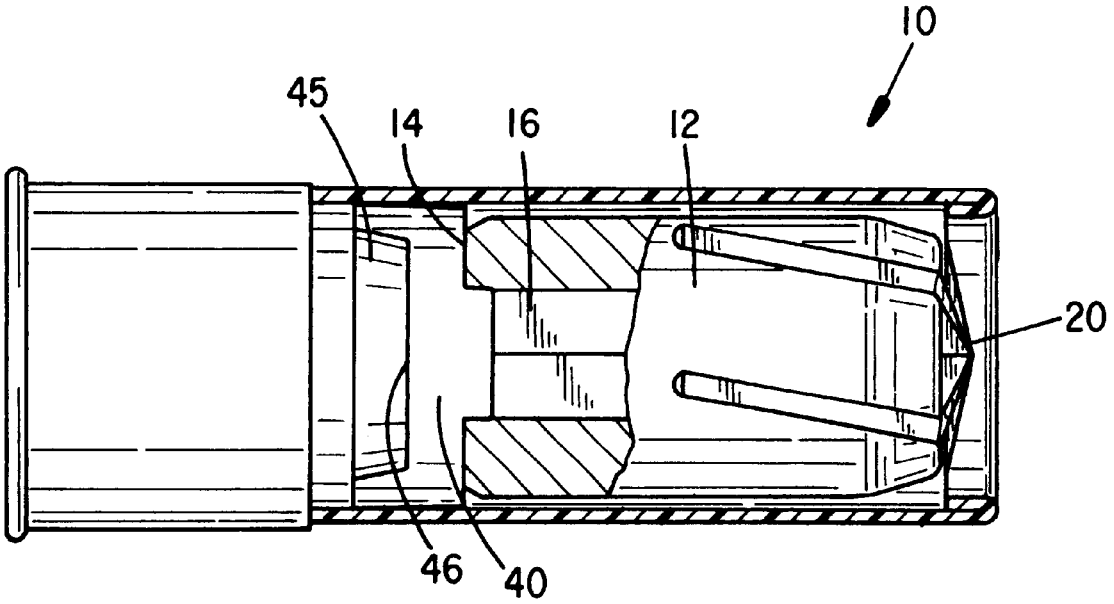
FIG. 1 is a fractional cross-sectional view of a new rotating tubular projectile according to the present invention.

With reference now to the drawings, and in particular to FIGS. 1 through 4 thereof, a new rotating tubular projectile embodying the principles and concepts of the present invention and generally designated by the reference numeral 10 will be described.

Figure 2:
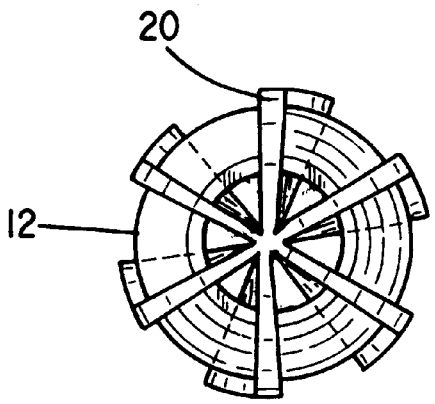
FIG. 2 is a front elevational view of the present invention.
Figure 3:
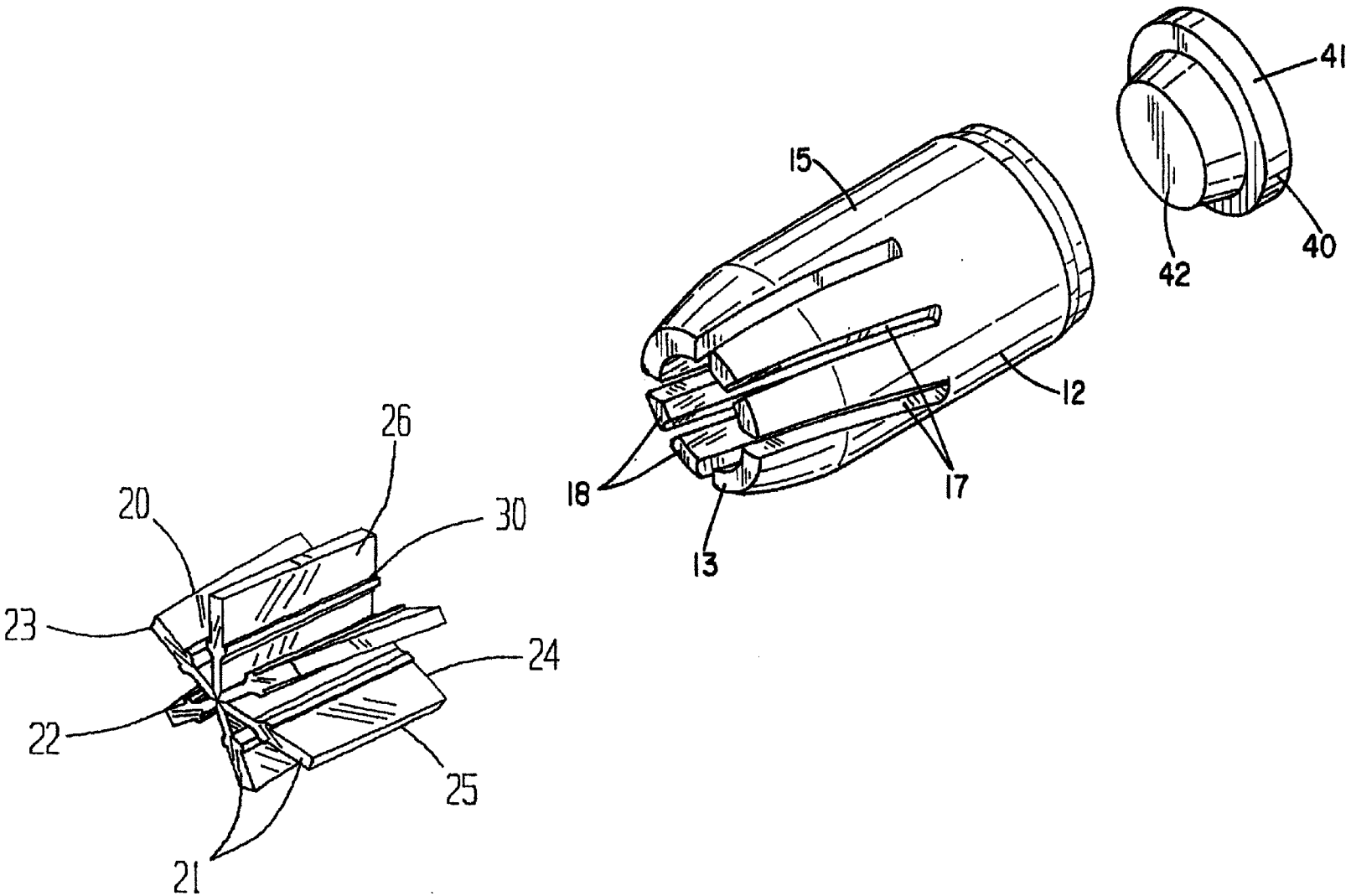
FIG. 3 is an exploded perspective view of the present invention.

As best illustrated in FIGS. 1 through 4, the rotating tubular projectile 10 generally comprises a cylindrical body 12 and a spiraled airfoil 20 mounted to the cylindrical body 12. As illustrated in FIG. 3, the cylindrical body 12 has an open first end 13 and an axial passageway 16 extending into the open first end 13 for receiving a flow of air.

In one embodiment of the present invention, the cylindrical body 12 has an open first end 13 and an open second end 14. The axial passageway 16 extends through the first 13 and second 14 open ends. A peripheral wall 15 extends between the open first 13 and second 14 ends of the cylindrical body 12 defining the axial passageway 16.

Figure 4:
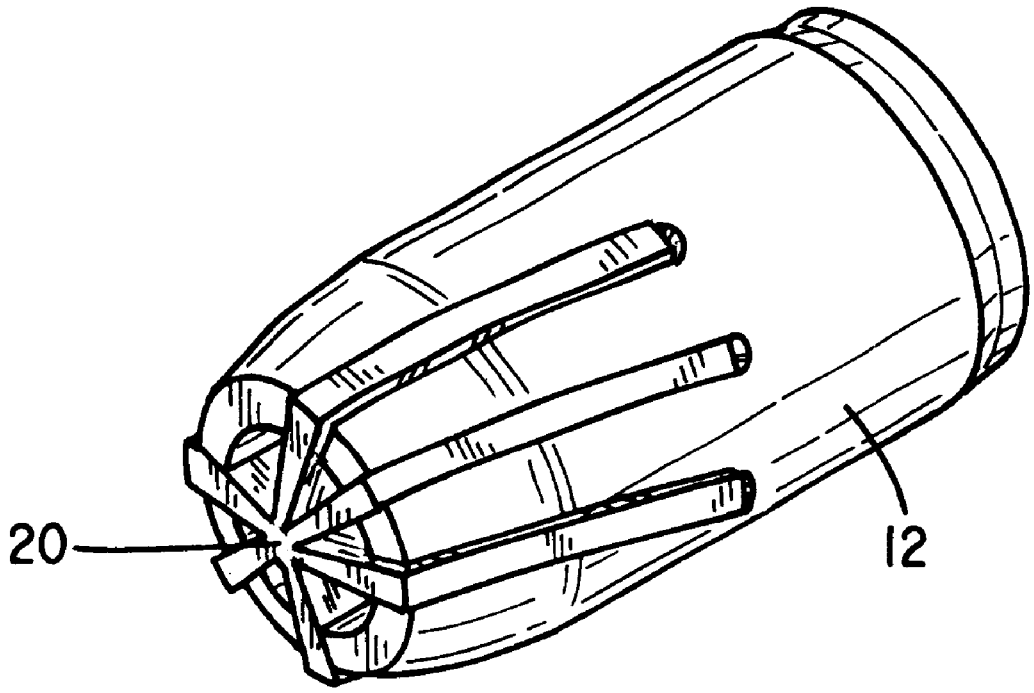
FIG. 4 is a perspective view of the present invention.

As illustrated in FIGS. 3 and 4, the cylindrical body 12 may taper from the open second end 14 toward the open first end 13 of the cylindrical body 12 for reducing drag of the projectile 10. The outer diameter of the cylindrical body 12 may also taper from a portion adjacent to the open second end 14 of the cylindrical body 12 toward the open second end 14 of the cylindrical body 12 for reducing drag upon the projectile 10.

The cylindrical body 12 may comprise a substantially rigid material such as brass, copper, steel or lead. However, the cylindrical body 12 may comprise any conventional substantially rigid material employed in the manufacture of projectiles.

As illustrated in FIG. 3, a plurality of slots 17 for receiving the spiraled airfoil 20 are circumferentially spaced about and extend through the peripheral wall 15 of the cylindrical body 12. Each of the slots 17 extends from the open first end 13 toward the open second end 14 of the cylindrical body 12. Each of the slots 17 may have a length approximately equal to half a length of the cylindrical body 12. Each of the slots 17 is preferably disposed at an angle with respect to a longitudinal axis extending through the cylindrical body 12. Each of the slots 17 may have an angular measurement of approximately ten degrees. However, any angular measurement may be employed.

The cylindrical body 12 further includes tab portions 18 defined by pairs of the slots 17. Each of the tab portions 18 is designed for expanding or bending back upon themselves for causing increased wound or damage to a target upon impact of the target. In one embodiment of the present invention, each of the tab portions 18 may have a length approximately equal to half a length of the cylindrical body 12.

The spiraled airfoil 20 is mounted in the axial passageway 16 of the cylindrical body 12 for impinging the flow of air traveling through the axial passageway 16. In one embodiment of the present invention, the spiraled airfoil 20 includes a plurality of vanes 21 that are coupled to and radially extending about a central axis portion 22 of the spiraled airfoil 20.

Each of the vanes 21 has a leading edge 23, a trailing edge 24 and a longitudinal edge 25 extending between the leading 23 and trailing 24 edges. The longitudinal edge 25 of each of the vanes 21 may be positioned in one of the slots 17 of the peripheral wall 15 of the cylindrical body. Each of the vanes 21 also includes a pair of generally opposed planar surfaces 26. The planar surfaces 26 impinge the flow of air flowing through the axial passageway 16 thus causing the cylindrical body 12 to rotate with respect to the longitudinal axis of the cylindrical body 12.

In one embodiment of the present invention, as particularly illustrated in FIG. 4, each of the vanes 21 is mounted in and extends through each of the slots 17 for facilitating movement of the cylindrical body 12 through the barrel of the firearm. Similar to a sabot, the portion of each of the vanes 21 extending through the slots 17 selectively abuts and prevents the cylindrical body 12 of the projectile 10 from contacting an inner surface of the barrel of the firearm.

The spiraled airfoil 20 preferably comprises a material that has a coefficient of friction less than the cylindrical body 12 for permitting increased velocity and rotation of the projectile 12 as it travels through the barrel of the firearm. The spiraled airfoil 20 may generally comprise a generally rigid material such as, for example, a plastic or similar polymer. However, any material may be employed in the manufacture of the spiraled airfoil 20.

Each of the vanes 21 may be generally angled with respect to a longitudinal axis of the cylindrical body 12 for impinging the flow of air flowing through the axial passageway 16. Each of the vanes 21 may have an angular measurement equal to the angular measurement of the plurality of slots 17 in the cylindrical body 12 permitting each of the vanes 21 to extend into one of the slots 17.

As particularly illustrated in FIG. 2, the portion of each of the vanes 21 extending through the slots 17 may also be generally angled with respect to a longitudinal axis of the cylindrical body 12. The angularity of the portion of the airfoil 20 extending through the cylindrical body 12 impinges a flow of air flowing along an outer surface of the cylindrical body 12 causing the cylindrical body 12 to rotate.

In one embodiment of the present invention, as particularly illustrated in FIG. 1, a length of each of the vanes 21 that extends between the leading 23 and trailing 24 edges may taper from the central axis portion 22 of the spiraled airfoil 20 toward the longitudinal edge 25 such that the central axis portion 22 of the spiraled airfoil 20 extends beyond the leading edge 23 of each of the vanes 21. The increased length of the central axis portion 22 of the spiraled airfoil 20 provides a more pointed airfoil 20 that reduces drag and increases the velocity of the projectile 10.

In one embodiment of the present invention, as particularly illustrated in FIG. 3, each of the vanes 21 has a pair of elongated rib portions 30 that extend generally between the leading 23 and trailing 24 edges. Each of the rib portions 30 is positioned generally adjacent to an inner surface of the cylindrical body 12 for centrally positioning the spiraled airfoil 20 in the axial passageway 16. Each of the rib portions 30 may have a generally transverse triangular cross section taken substantially perpendicular to a longitudinal axis of each of the rib portions 30.

In one embodiment of the present invention, the rotating tubular projectile 10 may be fired from a shotgun casing that has a forward end, a rearward end, a propellant positioned in the rearward end, and a primer mounted in the rearward end of the casing. In this particular embodiment of the present invention the projectile 10 includes a means of propelling 40 the cylindrical body 12 through the barrel of a shotgun. As illustrated in FIG. 1, the means of propelling 40 the cylindrical body 12 is removably mounted in the shotgun casing and is removably mounted in the open second end 14 of the cylindrical body 12.

The means of propelling 40 the cylindrical body 12 may include a cylindrical base portion 41 and a cylindrical boss portion 42. The cylindrical base portion 41 has a generally planar upper surface, a lower surface and a peripheral side surface. The cylindrical boss portion 42 is mounted on the upper surface of the base portion 41. The lower surface 46 of the base portion 41 has a cavity 45 extending therein for receiving the propellant.

The cylindrical boss portion 42 has a free end that is removably positionable in the open second end 14 of the cylindrical body 12. In one embodiment of the present invention, the base portion 41 of the means of propelling 40 the cylindrical body 12 has an outer diameter generally greater than the boss portion 42 of the means of propelling 40 the cylindrical body 12.

The peripheral side surface of the base portion 41, similarly to the portion of the vanes 21 extending through the cylindrical body 12, is selectively abuttable against the inner surface of the barrel of the firearm. The means of propelling 40 the cylindrical body 12 preferably has a coefficient of friction less than the cylindrical body 12 for permitting increased velocity and rotation of the projectile 10 as it travels through the barrel of the firearm. The means of propelling 40 the cylindrical body 12 and the spiraled airfoil 20 act as a sabot facilitating movement of the rotating tubular projectile 10 through the barrel of the firearm.

The means of propelling 40 the cylindrical body 12 preferably comprises a substantially rigid material such as, for example, a plastic material. However, other materials may also be employed.

In use, the rotating tubular projectile 10 is loaded into the barrel of a firearm. As the rotating tubular projectile 10 is fired from the firearm the portion of the vanes 21 extending through the cylindrical body 12 selectively abuts the inner surface of the barrel. As the rotating tubular projectile 10 travels down a length of the barrel, the opposed planar surfaces 26 of the spiraled airfoil 20 impinge an a flow of air flowing through the axial passageway 16 of the cylindrical body 12. The impingement of the airflow causes the rotating tubular projectile 10 to rotate, stabilizing the projectile and preventing it from pitching and yawing.

In an embodiment employing the means of propelling 40 the cylindrical body 12, the means of propelling 40 the cylindrical body 12 pushes the cylindrical body 12 through the barrel of the firearm. As the airflow flows through the axial passageway 16 it forces the boss portion 42 of the means of propelling 40 the cylindrical body 12 from the axial passageway 16 and is discarded.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the rotating tubular projectile. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A rotating tubular projectile for being discharged from a firearm, the firearm including a barrel having an open end extending into a bore of the barrel, said tubular projectile comprising:

a cylindrical body having an open first end, said cylindrical body having an axial passageway extending therein through said open first end, said cylindrical body having a plurality of elongated slots circumferentially spaced about and extending through a peripheral wall thereof, each of said slots being generally angled with respect to a longitudinal axis of said cylindrical body; and a spiraled airfoil being mounted in said axial passageway of said cylindrical body for impinging a flow of air flowing through said axial passageway, thus causing said cylindrical body to rotate about its longitudinal axis while exiting through the barrel and away from the firearm, said spiraled airfoil having a plurality of vanes coupled to and radially-extending from a central axis portion of said spiraled airfoil, wherein each of said vanes is positioned in each of said elongated slots extending through said peripheral wall.

2. The rotating tubular projectile of claim 1, wherein said cylindrical body further includes tab portions defined by pairs of said elongated slots, each of said tab portions being adapted to bend back upon themselves upon impact of said cylindrical body with a target.

3. A rotating tubular projectile for being discharged from a firearm, the firearm including a barrel having an open end extending into a bore of the barrel, said tubular projectile comprising:

a cylindrical body having an open first end, said cylindrical body having an axial passageway extending therein through said open first end; and a spiraled airfoil being mounted in said axial passageway of said cylindrical body for impinging a flow of air flowing through said axial passageway, thus causing said cylindrical body to rotate about a longitudinal axis while exiting through the barrel and away from the firearm, said spiraled airfoil includes a plurality of vanes coupled to and radially-extending from a central axis portion of said spiraled airfoil, each of said vanes has a leading edge, a trailing edge, a longitudinal edge extending between said leading and trailing edges and a pair of generally opposed planar surfaces, each of said vanes has a pair of elongated rib portions extending generally between said leading and trailing edges and extending away from each of said opposed planar surfaces for centrally positioning said spiraled airfoil in said axial passageway.

4. A rotating tubular projectile for being discharged from a firearm, the firearm including a barrel having an open end extending into a bore of the barrel, said tubular projectile comprising:

a cylindrical body having an open first end, said cylindrical body having an axial passageway extending therein through said open first end; and a spiraled airfoil being mounted in said axial passageway of said cylindrical body for impinging a flow of air flowing through said axial passageway, thus causing said cylindrical body to rotate about a longitudinal axis while exiting through the barrel and away from the firearm, said spiraled airfoil includes a plurality of vanes coupled to and radially-extending from a central axis portion of said spiraled airfoil, each of said vanes has a leading edge, a trailing edge, a longitudinal edge extending between said leading and trailing edges and a pair of generally opposed planar surfaces, said lateral edge of each of said vanes extends through said cylindrical body and away from an outer surface of said cylindrical body for facilitating movement of said cylindrical body through the barrel of a firearm.

5. The rotating tubular projectile of claim 4, additionally includes a pair of elongated rib portions extending generally between said leading and trailing edges and extending away from each of said opposed planar surfaces of each of said vanes for centrally positioning said spiraled airfoil in said axial passageway.

* * * * *